US008028448B2

(12) United States Patent
Amrani

(10) Patent No.: US 8,028,448 B2
(45) Date of Patent: Oct. 4, 2011

(54) PORTABLE SIGN FOR REAL ESTATE AND SMALL BUSINESSES

(76) Inventor: Allal Amrani, Seatac, WA (US)

( * ) Notice: Subject to any disclaimer, the term of this patent is extended or adjusted under 35 U.S.C. 154(b) by 0 days.

(21) Appl. No.: 12/263,149

(22) Filed: Oct. 31, 2008

(65) Prior Publication Data

US 2010/0043265 A1 Feb. 25, 2010

Related U.S. Application Data

(60) Provisional application No. 61/091,611, filed on Aug. 25, 2008.

(51) Int. Cl.
*G09F 15/02* (2006.01)

(52) U.S. Cl. ..... 40/607.09; 40/607.06; 248/508

(58) Field of Classification Search ..... 248/156, 248/508, 545; 40/607.05, 607.09, 645; 47/66.6
See application file for complete search history.

(56) References Cited

U.S. PATENT DOCUMENTS

| | | | | |
|---|---|---|---|---|
| 2,580,948 | A * | 1/1952 | Pancake | 40/607.08 |
| 3,880,395 | A | 4/1975 | Bompart | 248/464 |
| 4,685,233 | A | 8/1987 | Hull | 40/607.02 |
| 4,864,757 | A * | 9/1989 | Lovett | 40/610 |
| 4,866,866 | A | 9/1989 | Rotter et al. | 40/610 |
| 4,875,302 | A | 10/1989 | Noffsinger | 40/610 |
| 5,065,975 | A * | 11/1991 | Giles | 248/545 |
| 5,860,386 | A | 1/1999 | Schwab et al. | 116/63 P |
| 5,906,077 | A * | 5/1999 | Andiarena | 52/157 |
| 5,921,035 | A * | 7/1999 | Kempf | 52/157 |
| 6,343,446 | B1 * | 2/2002 | Beard | 52/165 |
| 6,412,743 | B1 * | 7/2002 | Fell | 248/441.1 |
| 6,668,474 | B2 | 12/2003 | Winterton et al. | 40/610 |
| 2002/0014428 | A1 * | 2/2002 | Kim | 206/423 |
| 2004/0216376 | A1 * | 11/2004 | Missry | 47/66.6 |
| 2005/0160647 | A1 | 7/2005 | Brown | 40/607.1 |
| 2005/0211857 | A1 | 9/2005 | Bolinder et al. | 248/156 |
| 2006/0011789 | A1 * | 1/2006 | Bergh | 248/156 |
| 2006/0026877 | A1 | 2/2006 | Dicke et al. | 40/607.1 |
| 2006/0042138 | A1 | 3/2006 | Lavelle | 40/607.09 |
| 2006/0101690 | A1 | 5/2006 | Terbet, Jr. | 40/607.09 |
| 2006/0185203 | A1 | 8/2006 | Bittle et al. | 40/541 |
| 2007/0094906 | A1 | 5/2007 | Milligan et al. | 40/604 |
| 2007/0107285 | A1 | 5/2007 | Ischkum | 40/607.09 |
| 2007/0261280 | A1 | 11/2007 | Rastegar | 40/541 |
| 2007/0266604 | A1 | 11/2007 | Garfinkle | 40/649 |
| 2008/0016736 | A1 | 1/2008 | Tollis et al. | 40/611.05 |
| 2008/0028652 | A1 | 2/2008 | Makhija et al. | 40/606.15 |

FOREIGN PATENT DOCUMENTS

| | | |
|---|---|---|
| JP | 03-125708 | 5/1991 |
| WO | WO 94/14484 | 7/1993 |
| WO | WO 2004/103770 | 12/2004 |

* cited by examiner

*Primary Examiner* — Joanne Silbermann

(57) ABSTRACT

A portable sign includes a light weight post and an arm that is pivotally attached by a hinge to an upper portion of the post and can be locked orthogonal to the post. The hinge enables the sign to be collapsed, such that the arm folds against the post, to facilitate storage and transport. In one embodiment, the post includes a shaft configured to be driven into the ground using a rotary drive tool. The shaft includes a head configured to engage the tool, which provides the motive force required to drive the lower portion of the post into the ground. Some exemplary embodiments employ a base configured to surround the lower portion of the post. The base can serve several functions, including providing support for the post, providing a container for flowers, and providing space for additional signage.

13 Claims, 5 Drawing Sheets

PORTABLE SIGN FOR REAL ESTATE AND SMALL BUSINESSES

RELATED APPLICATIONS

This application is based on a prior copending provisional application, Ser. No. 61/091,611, filed on Aug. 25, 2008, the benefit of the filing date of which is hereby claimed under 35 U.S.C. §119(e).

BACKGROUND

Portable temporary signs are for advertising in a variety of contexts and applications. The real estate industry ubiquitously employs white wooden framed signs.

Conventionally, a real estate agent hires a sign contractor to dig a hole and erect a heavy 4×4 inch wood post in the front yard of a home to be sold. The wood post has a shorter 4×4 inch segment extending horizontally from the top of the post (to generally form an "r" shaped frame). Real estate signage is hung from the horizontally extending section.

Renting such signs can cost in excess of $100/month. A pick-up truck or large utility vehicle is typically required for moving the signs and posts to and from a site, due to their size and weight. It would be desirable to provide an alternative to this type of signage that is less expensive, movable in a standard automobile trunk, and which can be readily erected at the site by a real estate agent.

SUMMARY

Disclosed herein is a portable sign that is particularly well suited for use in selling real estate, but can also be used as portable signage for other types of businesses. In some embodiments the portable sign is provided as a frame to which a user adds their own custom signage, thus the concepts disclosed herein encompass both portable frames to which signage can be added, as well as complete portable signs (i.e., frames and signage).

The portable sign includes a light weight post and an arm that is hingedly attached to an upper portion of the post. The hinge enables the sign to be collapsed, such that the arm folds against the post (such that the arm and post are parallel in the collapsed form), to facilitate storage and transport of the sign. The arm can be locked into its extended position, by use of a locking hinge or by passing a lock pin though aligned orifices disposed in both the arm and post. When deployed, the post will be oriented vertically and the arm will be oriented horizontally, such that the arm and post are substantially orthogonal to one another.

Preferably, the post and arm are made of metal, although rigid and light weight polymers can also be employed.

Significantly, the portable sign is sufficiently small and light weight that it can be moved by a single person (including a petite female real estate agent), and so that multiple portable signs can readily be stored in the trunk of a typical conventional car.

In one exemplary embodiment, an upper portion of the post includes a flat head that is configured to receive blows from a hammer or mallet that is used to pound a bottom portion of the post into the ground. In such an embodiment, the bottom portion of the post has a pointed tip to facilitate the post being driven into the ground.

In another exemplary embodiment, the post includes a shaft coupled to a lower portion of the post, the shaft being configured to be driven into the ground (or a concrete surface driveway, sidewalk, or other type of surface where a sign might be erected) using a rotary drill or driver. The shaft includes a head configured to engage a rotary drive tool, which then provides the motive force required to drive the lower portion of the post into the ground or other surface.

Another aspect of the new signage system is a support base, which is configured to surround the lower portion of the post. The base serves a variety of functions. It can be filled with sand bags or other weighting material to support the post, if the post cannot be driven into the ground. In some exemplary embodiments, to provide significant support for the lower portion of the post, the base includes a top or cover that forms an interference fit with the post. An internal support element can be formed in the base to receive the post.

The base can also be used to provide a container for flowers, real or artificial, to provide more aesthetically pleasing signage. The base can further be used for supporting additional signage, such as advertising for mortgage brokers, home repair, etc. The base need not be circular; for example, an oval base will provide more area for signage. The base can include support for holding multiple signs in place, and can be configured so that the signs can be easily replaced, as desired.

This Summary has been provided to introduce a few concepts in a simplified form that are further described in detail below in the Description. However, this Summary is not intended to identify key or essential features of the claimed subject matter, nor is it intended to be used as an aid in determining the scope of the claimed subject matter.

DRAWINGS

Various aspects and attendant advantages of one or more exemplary embodiments and modifications thereto will become more readily appreciated as the same becomes better understood by reference to the following detailed description, when taken in conjunction with the accompanying drawings, wherein:

FIG. 1A schematically illustrates an exemplary portable sign frame in a collapsed configuration;

FIG. 1B schematically illustrates an exemplary portable sign frame with an arm being moved from a collapsed position for storage and transport to a deployed configuration in which the arm will extend horizontally;

FIG. 1C schematically illustrates an exemplary portable sign frame with an arm in the deployed configuration, supporting signage;

FIGS. 2A-2D schematically illustrate exemplary cross-sectional shapes for the posts and arms disclosed herein;

FIG. 3 schematically illustrates an alternative to a locking hinge, in which both a post and an arm (referenced in the deployed configuration) include openings or orifices that are aligned to receive a pin, when the arm and the post are generally orthogonal to one another, so that the orthogonal relationship is maintained;

FIG. 4A schematically illustrates an exemplary embodiment of a portable sign that includes a base in addition to the collapsing frame, with signage depending from an arm and signage attached to the supporting base;

Figure 6:
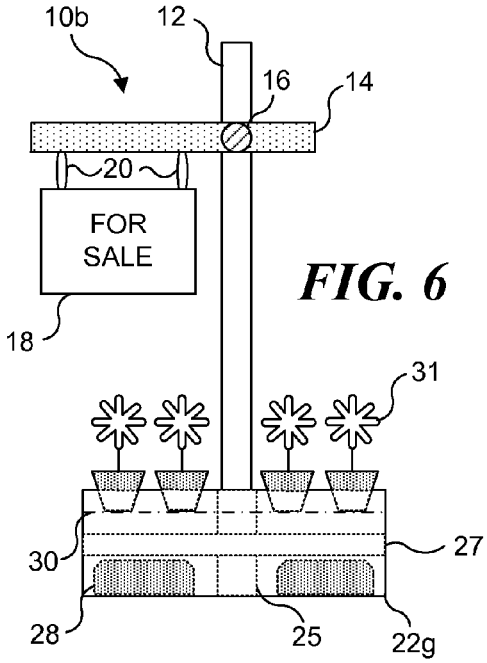
Figure 7:
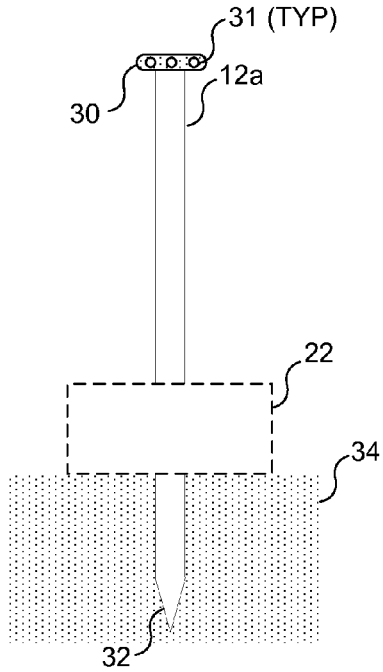
Figure 8A:
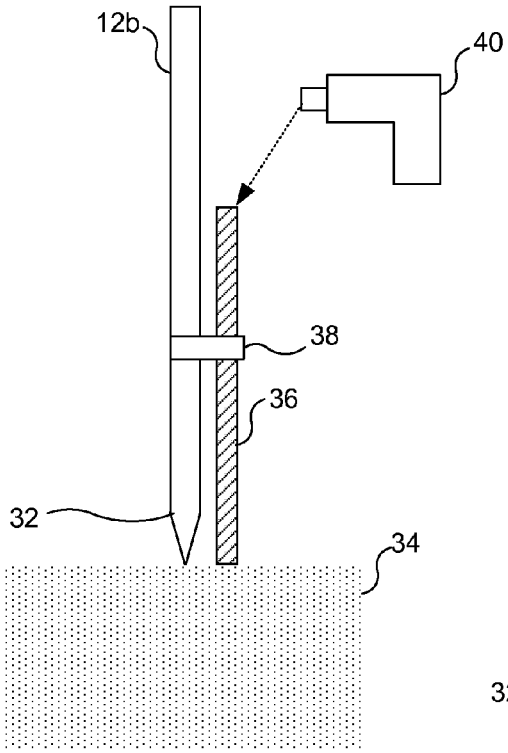
Figure 8B:
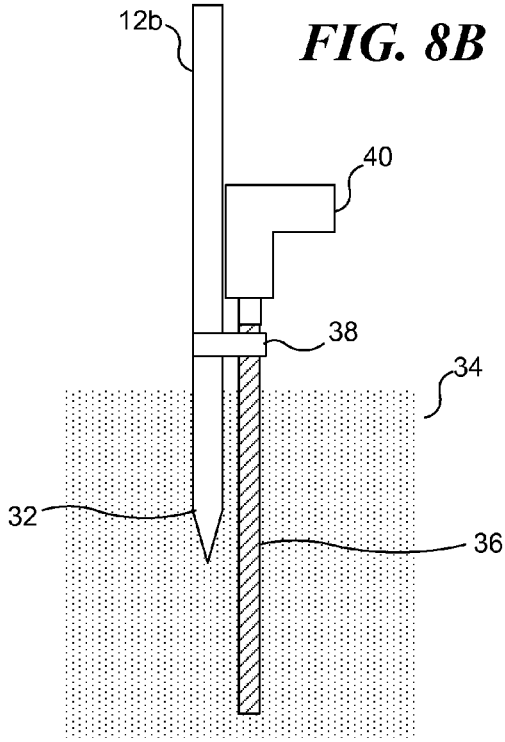
Figure 8C:
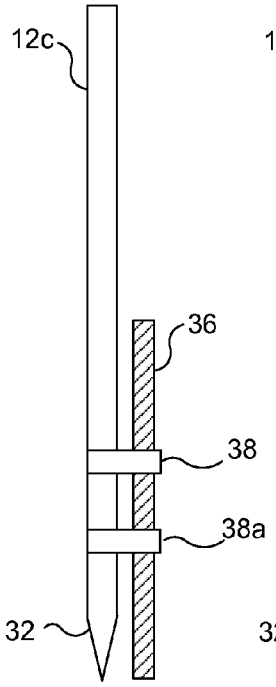
Figure 8D:
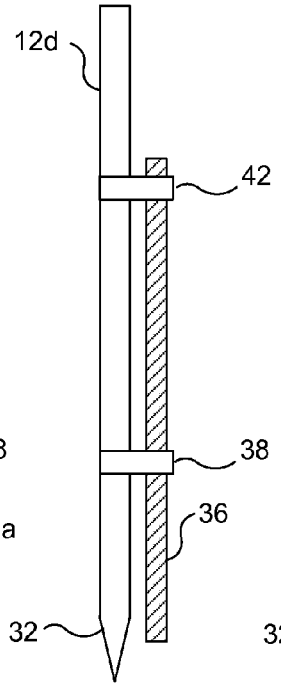
Figure 8E:
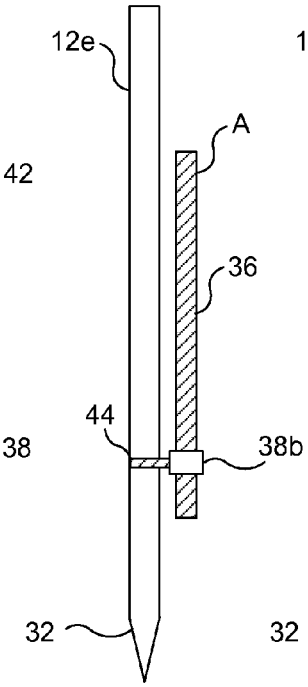
Figure 8F:
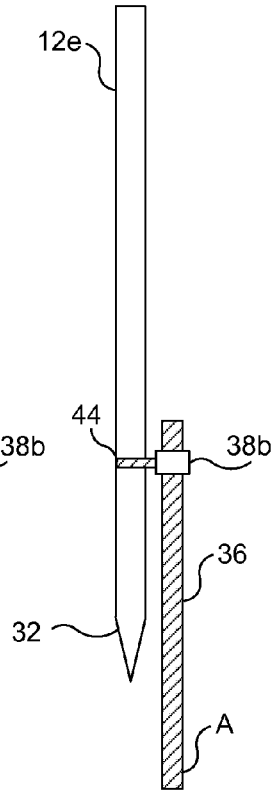
Figure 8G:
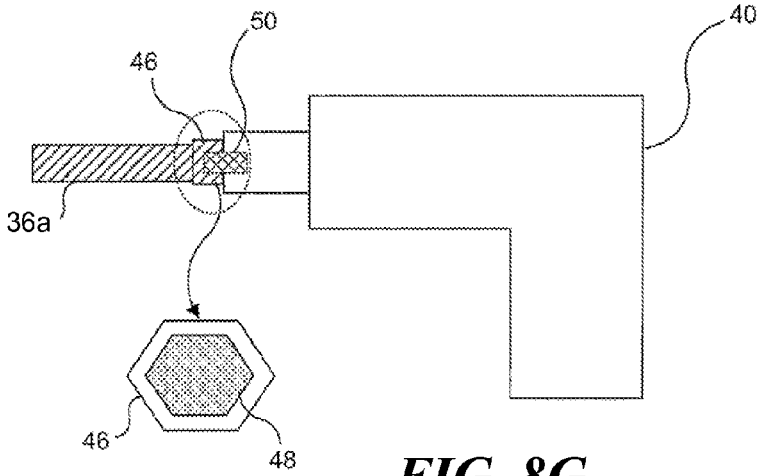
Figure 9A:
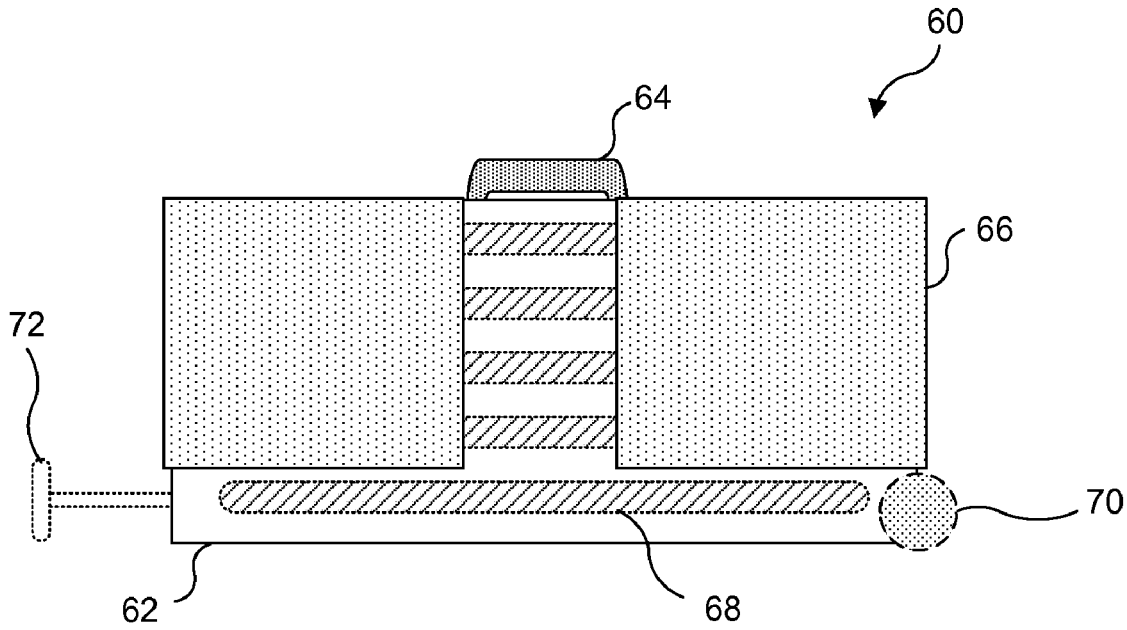
Figure 9B:
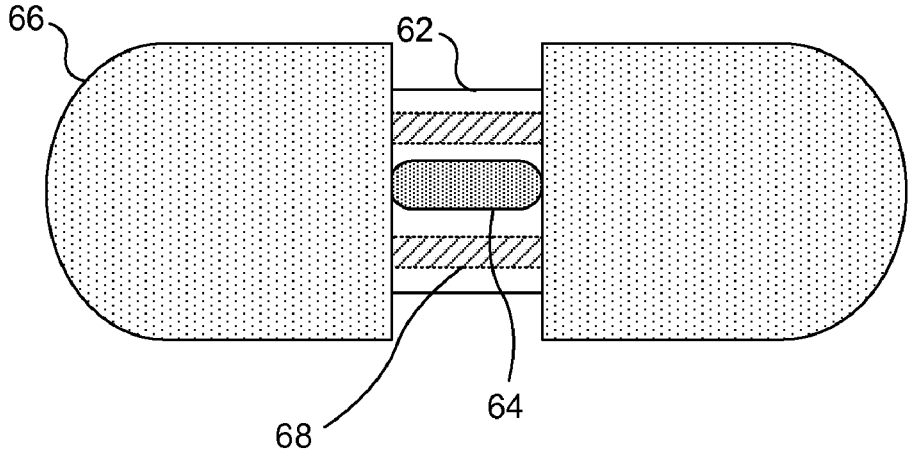

FIG. 6 schematically illustrates an exemplary embodiment of a portable sign including a supporting base having a shelf for decorative elements and including internal elements to support the post;

FIG. 7 schematically illustrates an exemplary post embodiment for use with one or more of the portable frames and portable signs disclosed herein, wherein the post includes a pointed tip at its lower portion that is configured to be driven into the ground, and an upper end includes a flat head configured to be struck with a tool (such as a mallet or sledge hammer) to drive the post into the ground;

FIGS. 8A and 8B schematically illustrate an exemplary post embodiment for use with one or more of the portable frames and portable signs disclosed herein, including a pointed tip at its lower portion that is configured to be driven into the ground, a support coupled to a lower portion of the post, and a shaft rotatably supported by the support, such that the shaft can be rotated by a rotary drive tool to drive the post into the ground;

FIG. 8C schematically illustrates an exemplary post embodiment related to the embodiment of FIGS. 8A and 8B, which includes an additional support coupled to the lower portion of the post;

FIG. 8D schematically illustrates an exemplary post embodiment related to the embodiment of FIGS. 8A and 8B, and which includes a bracket for securing the shaft when the post is transported or stored;

FIGS. 8E and 8F schematically illustrate an exemplary post embodiment related to the embodiment of FIGS. 8A and 8B, and which includes a support that is rotatably coupled to the post, such that when the support is in a first position (as shown in FIG. 8E), the shaft does not extend beyond a lower extent of the post, facilitating transportation and storage of the post; and when the support is in a second position (as shown in FIG. 8F), the shaft does extend beyond a lower extent of the post, facilitating deployment of the post at a site;

FIG. 8G schematically illustrates an exemplary shaft for use in any of the embodiments of FIGS. 8A-8F, where a rotary drive tool includes a driving bit specifically configured to engage a head of the shaft; and FIGS. 9A-9B schematically illustrate an exemplary signage system including a case for storing a plurality of folding sign frames, wherein a plurality of clamshell type supporting bases can be attached to the case.

DESCRIPTION

Figures and Disclosed Embodiments Are Not Limiting

Exemplary embodiments are illustrated in referenced Figures of the drawings. It is intended that the embodiments and Figures disclosed herein are to be considered illustrative rather than restrictive. No limitation on the scope of the technology and of the claims that follow is to be imputed to the examples shown in the drawings and discussed herein.

The concepts disclosed herein encompass both portable frames for signage, as well as portable signs. In some embodiments, a portable frame is provided so an end user can provide their own signage, while in other embodiments, signage is provided along with the frame.

Preferably, the portable frames (and portable signs) disclosed herein are configured to be relatively light in weight, and relatively compact in size when not deployed, such that a single person of only average build and strength can readily move and deploy a portable frame/portable sign at a site. Furthermore, the portable frame/portable sign can fit in the trunk of an average automobile (i.e., a compact or midsize auto), such that the signage can be moved from one location to another without requiring a pickup truck, large utility vehicle, or delivery van. While such relatively compact portable frames/portable signs are particularly well suited for use in the real estate industry, these portable frames/portable signs can also be used by other types of small businesses, and to provide portable signage for conventions and other events. It should be recognized that while such relatively small and readily portable signage represents a desirable exemplary embodiment, the concepts disclosed herein can also be applied to relatively larger signage, which could be made sufficiently large as to require more than one person to deploy the signage, or which might require the use of a relatively larger vehicle to move the signage.

Figure 1A:
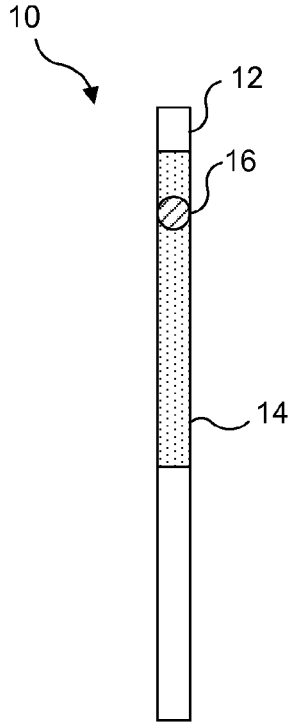

FIG. 1A schematically illustrates a portable sign frame 10 in a collapsed configuration. Frame 10 includes a post 12, an arm 14, and a hinge 16 that movably couples the arm to the post.

As used herein and in the claims that follow, the term "post" is used to refer to the component of the frame that is oriented vertically when the sign frame is deployed for supporting signage and the term "arm" is used to refer to the component of the frame that is oriented horizontally when the sign frame is deployed for supporting signage. It will be understood that these components are not necessarily vertical or horizontal when the sign frame is not deployed.

Figure 1B:
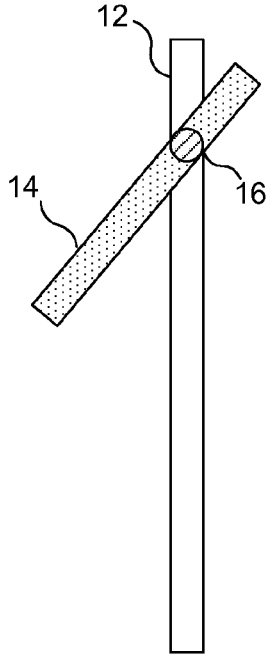
Figure 1C:
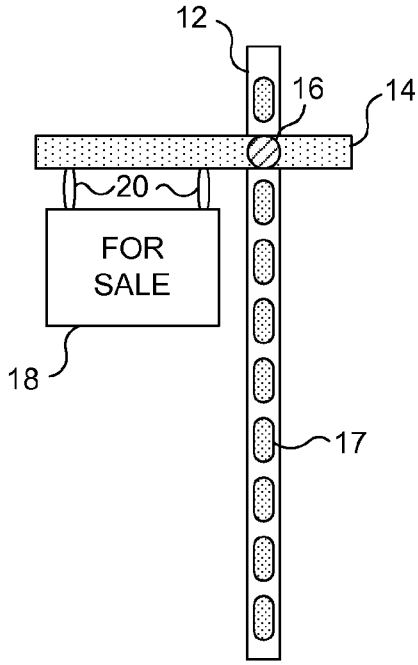

FIG. 1B schematically illustrates frame 10 with arm 14 being moved from the collapsed position to a deployed configuration. FIG. 1C schematically illustrates frame 10 with arm 14 in the deployed configuration, with supporting signage 18 depending from arm 14. Signage 18 can be attached to arm 14 using many different types of attachment means 20, including but not limited to the use of plastic zip ties, wire, cable, chain, rope, cordage, or string.

Post 12 can be implemented using a number of different materials, including, wood, polymers, or metals, as well as combinations thereof. Where ease of portability and light weight are desired characteristics, polymers and metals are generally preferred. When a metal post is employed, and a lower portion of the metal post is intended to be driven into the ground, various coatings (such as paint and/or a polymer coating) can be applied to prevent that portion from being damaged by corrosion due to the presence of moisture in the ground. Arm 14 can also be implemented using a number of different materials, including, wood, polymers, or metals, or combinations thereof As noted above, polymers and/or metals are generally preferred where ease of portability and light weight are desired characteristics. In one particularly desirable exemplary embodiment for use in the real estate industry, where the portable sign is designed to be moved by one person and to fit in the trunk of an average car, both the post and the arm are implemented in a light-weight but strong metal or plastic. If desired, either or both the post and arm can be coated with paint or other coatings in eye catching colors, such as orange or fluorescent yellow (such colors being exemplary, rather than limiting).

As shown in FIG. 1C, a plurality of openings 17 can be formed into the post. These openings perform a plurality of different functions, including reducing the weight of the post, reducing a wind resistance of the post (i.e., wind can pass through the openings), and providing attachment points for additional components, such as additional signage or boxes for real estate fliers or other promotional materials. It should be recognized that similar openings can be formed into arm 14. Openings 17 can also be used to attached post to an existing structure, such as a fence or building, so that the bottom portion of the post does not need to be driven into the ground or other supporting substrate, or held in a base for support.

As shown in FIG. 1C, a portion of arm 14 extends beyond the perimeter of the post in two directions (i.e., a first direction extending toward signage 18, and a second direction extending away from signage 18, where a relatively longer portion of arm 14 extends in the first direction and a relatively shorter portion of arm 14 extends in the second direction). It should be recognized that arm 14 need not extend in the second direction at all.

Figure 2A:
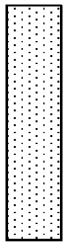
Figure 2B:
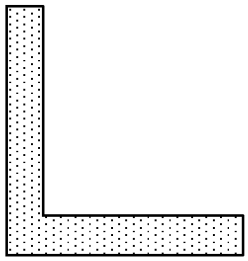
Figure 2C:
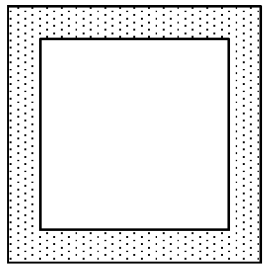
Figure 2D:
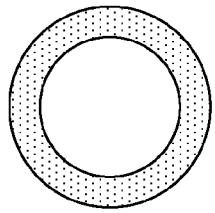

FIGS. 2A-2D schematically illustrate various cross-sectional shapes that can be used to implement one or both the post and the arm. FIG. 2A schematically illustrates a generally rectangular form factor. FIG. 2B schematically illustrates a generally L-shaped form factor (note that metal stock is often available in this form factor; further, it should be recognized that the lengths of the generally orthogonal arms need not be equal). FIG. 2C schematically illustrates a generally hollow square form factor, while FIG. 2D schematically illustrates a generally hollow circular (oval is a further alternative) form factor. Metal stock and plastic stock are often available in such form factors, and the hollow interior enables weight reduction of these components without sacrificing strength. While these cross-sectional shapes represent several specific form factors that might be used, it should be recognized that such form factors are simply exemplary, and not limiting.

Referring once again to FIGS. 1A-1C, it should be recognized that many types of hinges can be used to implement hinge 16. The purpose of hinge 16 is to enable the signage frame to be collapsed for transport and storage, such that in the collapsed configuration, the arm and the post are pivoted to be generally parallel, rather than being orthogonal to each other. One type of hinge used for performing a similar function can be found in metal bed frames, which can collapse for storage and transport. In the collapsed configuration, such metal bed frames fit in an elongate box having a relatively small rectangular cross-section, and each section of the bed frame is generally parallel to each other section. In the deployed configuration, the metal bed frames have a generally rectangular form factor, where a head section and a foot section are parallel to one another, and orthogonal to two side sections, which are themselves also generally parallel to each other.

Figure 3:
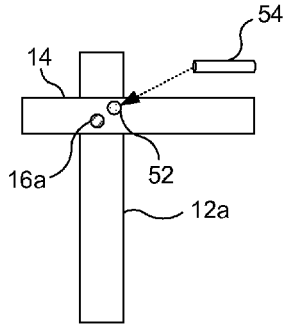

In at least one exemplary embodiment, hinge 16 can be locked into the deployed configuration (i.e., where the arm and the post are generally orthogonal to one another). Locking hinges are known in the art and need not be described further. FIG. 3 schematically illustrates an alternative to a locking hinge, in which both a post 12*a* and an arm 14*a* include orifices 52 that align when the arm and the post are generally orthogonal to one another. A lock pin 54 can then be inserted into the aligned orifices, thereby locking the arm and the post in the orthogonal configuration. The pin can be attached to either the arm or the post using a chain or cable to prevent the pin from being lost when the post and the arm are in the collapsed configuration (i.e., when pin is not inserted into the aligned orifices or openings).

Figure 4A:
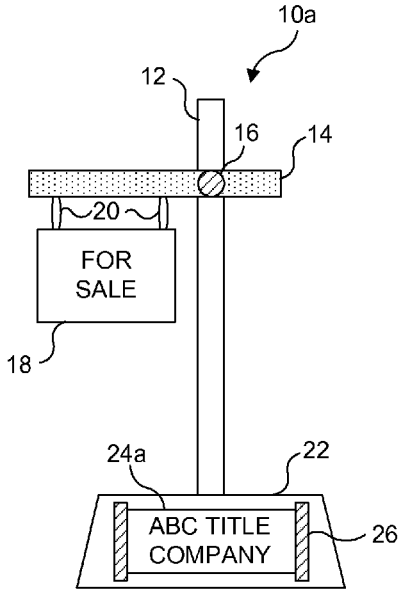
FIG. 4B is an end view of the portable sign of FIG. 4A, showing additional signage disposed at a different location on the supporting base.

FIG. 4A schematically illustrates an exemplary embodiment of a portable sign 10*a* including a base 22, in addition to the collapsing frame shown in FIGS. 1A-1C, with signage 18 depending from arm 14, and additional signage 24*a* attached to the supporting base using brackets 26. It should be recognized that other means of attaching signage 24*a* to base 22 can be employed, including but not limited to, fasteners and adhesives. Furthermore, it should be recognized that signage 24*a* can be permanently attached to base 22, by painting, screen painting, and other printing techniques.

Significantly, base 22 can perform a plurality of functions, including providing support to post 12, and providing space for additional signage. Particularly with respect to the real estate industry, the ability to add additional signage provides a significant benefit. While the primary signage (i.e., signage 18) often specifies the listing agent and the listing real estate company, the additional signage can provide opportunities for displaying advertising for other parties, to enable the realtor to receive advertising revenue to offset the capital cost of initially acquiring the portable signs and portable frames described herein, and to provide an additional income stream. Advertisers that would likely be interested in utilizing additional signage for advertising purposes in the real estate context include, but are not limited to, title companies involved in real estate transactions, attorneys specializing in real estate transactions, and handymen, repairmen, painters, gardeners, and contractors offering home-improvement services.

Figure 4B:
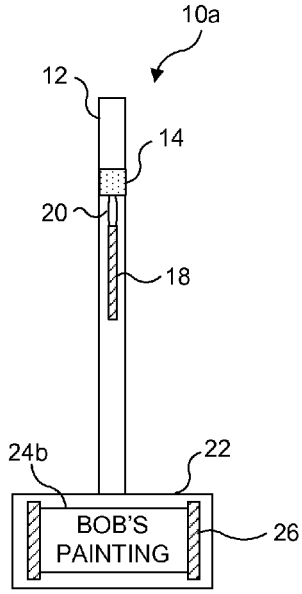

It should be recognized that base 22 will generally include more than one surface that can be used for additional signage. For example, assume that FIG. 4A represents a view of portable sign 10*a* that a motorist would see when approaching a property. Depending on the form factor of base 22, the base will likely include an additional surface on which additional signage can be placed to be seen by a motorist approaching the property from the opposite direction. Furthermore, referring to FIG. 4B, signage 24*b* would be visible through a side window of a vehicle as the vehicle passes the property. Thus, a base having four sides can accommodate signage on three of the four sides; first and second sides that can be seen by motorists approaching from opposite directions, and a third side can be seen when the portable sign is passed by a motorist. The fourth side of the base will likely face the home or property, and thus would only be visible to a motorist if the motorist got out of their vehicle and walked about the property.

There are competing priorities for whether the internal volume of base 22 should be relatively empty or relatively full of a material providing weighting to the base. Relatively empty internal volumes will reduce a weight and mass of the base, facilitating transportation and storage. For example, where the internal volume of the bases is empty, many bases can be stacked together to reduce storage space requirements. In contrast, relatively full internal volumes will enhance the stability of the base due to the weight of the internal mass in the volume. This conflict can be solved by providing bases with internal volumes that can be filled with a readily available material at the site, when the base is being used to support a portable sign. While the concepts disclosed herein do encompass bases with prefilled internal volumes, it should be recognized that bases with the ability to hold added mass in their internal volumes are likely to be more useful. Where the base is watertight, such empty internal volumes can be easily filled with water to provide enhanced stability and support to the post (if freezing weather is expected, anti-freeze solution can be used). Other exemplary fill materials include sand (either bagged or loose) and dirt, although it should be recognized at a such materials are intended to be exemplary rather than limiting. Particularly for real estate signage, water is almost always readily available at residential properties. The amount of ballast weight to be employed can be selected by the user. An exemplary ballast weight range is 25 to 30 pounds, although it should be recognized that such a range is not intended to be limiting. In most embodiments, the base will have a flat bottom, although in some embodiments, the bottom of the base may include surface features, such as cleats or spikes that help seat the base on surfaces such as grass and earth. Such surface features may also be incorporated into the bottom of the sidewalls. Finally, in at least some embodiments, the base will include only a partial bottom, or no bottom at all. There is no specific limitation on the dimensions of the base. An exemplary, but not limiting base is about 1 foot tall, about 1.5 feet wide, and about 2.5 feet long. In some embodiments, the sidewalls can be orthogonal to the bottom of the base, although it should be recognized that the concepts disclosed herein encompass bases having sloping sidewalls, such that a bottom of the base is relatively larger that a top of the base, and vice-versa.

While a four-sided base was discussed in the example above, it should be recognized that bases employed for support and to provide additional signage opportunities need not be limited to shapes having four sides. FIGS. 5A-5F schematically illustrate several different exemplary cross-sectional shapes for bases. It should be recognized that such cross-sectional shapes are intended to be exemplary, rather than limiting. Each of FIGS. 5A-5F represent a top plan view of a base, with a likely position of post 12 being shown relative to the perimeter of the base. In general, post 12 has been placed in the center of each base, although it should be recognized that placement of the post in such a position is exemplary, rather than limiting. While not specifically shown, it should be recognized that a cover can be added to any of the bases described herein, so long as the cover includes an opening through which the post can pass.

Figure 5A:
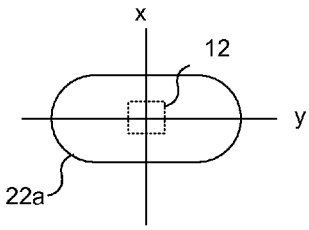
FIGS. 5A-5F are top plan views of different exemplary, but not limiting, supporting bases that can be employed to support the sign post, each such exemplary supporting base having a different shape.

FIG. 5A schematically illustrates an exemplary base 22*a* that includes two generally planar sides and two generally curved sides. The curved surfaces are likely to draw the attention of a viewer to a larger degree than a planar surface would; thus, signage placed on the curved surfaces may be more effective for advertising purposes. FIG. 5A also indicates an x-axis and a y-axis. In an exemplary, but not limiting embodiment, base 22*a* can be separated into two or more parts to facilitate storage or transport. Providing base 22*a* as a two-piece construction, with the two components separated along either the x-axis or y-axis, represents an exemplary, but not limiting, embodiment. Many different attachment mechanisms can be employed to secure the individual portions of the base together in the deployed configuration, including clamps and latches (such structures and mechanisms being exemplary, rather than limiting).

Figure 5B:
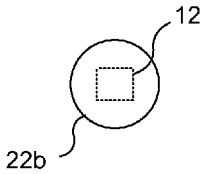

FIG. 5B schematically illustrates a base 22*b* having a generally circular form factor. The relative size of the signage placed on base 22*b* will determine how many different types of signage can be accommodated by base 22*b*. It should be recognized that the specific diameter of base 22*b* relative to a cross-sectional area of post 12 can be varied as desired.

Figure 5C:
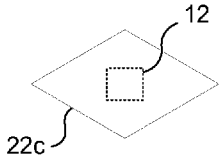

FIG. 5C schematically illustrates an exemplary base 22*c* exhibiting a quadrilateral form factor including four generally planar sides. Assuming that the base of FIG. 4A has a form factor corresponding to FIG. 5C, it is likely that only two of the four generally planar sides would be clearly visible to motorists (unless the sign is disposed on a corner of an intersection), thus the form factor of FIG. 5C may not be particularly desirable for real estate signage. However, in the context of signage for small businesses and convention centers (i.e., signage to attract the attention of ambulatory persons, rather than persons driving in vehicles), the four planar sides of base 22*c* in FIG. 5C will offer signage opportunities that can be seen by individuals approaching from many different directions.

Figure 5D:
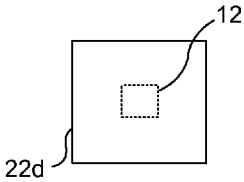

FIG. 5D schematically illustrates a base 22*d* exhibiting a square form factor, also including four generally planar sides. Assuming that the base of FIG. 4A has a form factor corresponding to FIG. 5D, it is likely that three of the four generally planar sides would be clearly visible to motorist. Thus, the form factor of FIG. 5C may be particularly desirable for real estate signage, as well as signage for small businesses and convention centers (i.e., signage to attract the attention of ambulatory persons, rather than persons driving in vehicles).

Figure 5E:
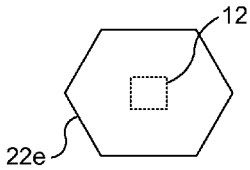

FIG. 5E schematically illustrates a base 22*e* having a hexagonal form factor including six generally planar sides. Assuming that the base of FIG. 4A has a form factor corresponding to FIG. 5E, it is likely that four of the six generally planar sides would be clearly visible to motorists. Thus the form factor of FIG. 5E may be particularly desirable for real estate signage, as well as signage for small businesses and convention centers (i.e., signage to attract the attention of ambulatory persons, rather than persons driving in vehicles).

Figure 5F:
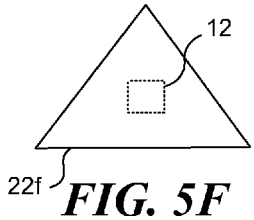

FIG. 5F schematically illustrates a base 22f exhibiting a triangular form factor including three generally planar sides. Assuming that the base of FIG. 4A has a form factor corresponding to FIG. 5F, it is likely that two of the three generally planar sides would be clearly visible to motorists. With fewer sides visible to motorists, the form factor of FIG. 5E may not be particularly desirable for real estate signage, but may be desirable for signage for small businesses and convention centers (i.e., signage to attract the attention of ambulatory persons, rather than persons driving in vehicles).

FIG. 6 schematically illustrates an embodiment of a portable sign 10*b* including a supporting base 22g with an internal shelf 30 for decorative elements 32 and internal elements to support post 12.

As illustrated, internal shelf 30 is supporting a plurality of decorative elements 31. While many different types of decorative elements can be employed, potted plants (real or artificial) are readily available and aesthetically pleasing. Internal shelf 30 can be fixed in place or removable. A removable internal shelf can be readily implemented by providing a flange around an internal perimeter of the interior volume of the base, such that the shelf is supported by the flange. Additional columnar type support structures can be provided in the internal volume of the base if the flange is not adequate to provide the required support. It should be noted that a cover or lid can be used in place of the internal shelf.

Internal element 28 generally represents a removable mass added to the interior volume during deployment of the portable sign to provide additional support. As discussed above, this removable mass can include (but is not limited to) water, containers filled with water, loose sand, bags filled with sand, loose dirt or rocks, and bags filled with dirt or rocks.

Internal support 25 generally represents a column having a form factor that will accommodate the post to provide support. It should be noted that a bottom portion of the post can have several different form factors, including a flat bottom, and a pointed tip that is configured to be driven into the ground. In general, where a base is employed to provide support to the post, the bottom of the post can be flat. However, it should be recognized that internal support 25 can have an opening at the bottom such that the bottom portion of the post can pass through the base and be driven into the ground, generally as shown in FIG. 7 and discussed in greater detail below. In such an embodiment, internal support 25 represents a central hollow member.

Internal support element 27 generally represents a reinforcing structure extending from internal support 25 to provide additional support and rigidity. In at least one exemplary embodiment, internal support element 27 extends from internal support 25 to a perimeter of the base, although it should be recognized that such a configuration is only intended to be exemplary, rather than limiting.

While the frame including a post and arm hingedly coupled together represents a particularly preferred type of frame, it should be recognized that the bases disclosed above can be used together with a post and arm that are coupled together using other techniques. In other words, rather than using the novel base with the novel hinged frame disclosed herein, the novel base could also be used with conventional sign post/arm combinations (i.e., a post and arm combination that does not employ a collapsing hinge).

FIG. 7 schematically illustrates a post 12*a* for use with one or more of the portable frames and portable signs disclosed herein, including a pointed lower tip portion 32 configured to be driven into ground 34, and an upper end including a flat head 30 configured to be struck with a tool to drive the post into the ground. When post 12*a* is intended to be used with a base, an opening in the bottom of base 22 is provided to enable lower portion 32 to readily pass through base 22. The amount of the post that extends into the ground can be varied as desired. An exemplary, but not limiting extent is about one to two feet. Optionally, flat head 30 may include a plurality of openings 31 that can be used to attached balloons or other decorative elements to the sign.

FIGS. 8A and 8B schematically illustrate a post 12*b* for use with one or more of the portable frames and portable signs disclosed herein, including pointed tip lower portion 32 that is configured to be driven into ground 34, a support 38 coupled to a mid portion of post 12*a*, and a shaft 36 rotatably supported by support 38, such that shaft 36 can be driven by a rotary drive tool 40 to drive the post into the ground. Support 38 includes an opening large enough to accommodate shaft 36. If desired, the walls of the opening can function as a bearing (i.e., a journal portion of the shaft is designed to be rotatably supported by the bearing in the support). In other embodiments, the opening in the support is relatively larger than the diameter of the shaft, such that the shaft can rotate without contacting the support, and the support simply ensures that a spacing between the shaft and the post remains relatively constant (i.e., that the shaft remains spaced apart from the post). In such an embodiment, the bottom of the post should be driven into the ground as well as the bottom of the shaft, as the shaft and post will be able to move slightly relative to each other (the larger the opening in the support, the greater the relative movement). While not required, in one desired exemplary embodiment, the support and shaft are threaded.

A bottom portion of shaft 36 can be optimized for penetration of specific types of supporting substrates. Where the supporting substrate is ground (i.e., dirt), the bottom portion can either be a sharp pointed tip (such as tip portion 32 of post 12*b*) or be formed as an auger (i.e., having a relatively coarse helical screw). When the supporting substrate or surface is asphalt or concrete, the bottom portion can be fabricated of materials and form factors generally chosen as suitable to penetrate asphalt or concrete. Thus, in some exemplary embodiments, the lower portion of the shaft is configured for penetration, and the upper portion is configured to rotatably engage the support.

The length of the shaft can vary as desired, but the shaft should be sufficiently long to provide support for the post. While FIG. 8B shows the lower portion of the post penetrating the supporting substrate (i.e., the ground), it should be recognized that so long as the shaft is rigidly and rotatably coupled to the post (via one or more supports), and the shaft itself extends into the ground, the post need not extend into the ground any appreciable distance. In some applications, the post may not need to penetrate into the ground at all.

FIG. 8C schematically illustrates a post 12*c* related to the exemplary embodiment of FIGS. 8A and 8B, and which includes an additional support 38*a* coupled to the lower portion of the post for additional support for shaft 36. The positions of the supports relative to the post can be determined based on how much, if any, of the post will extend into the ground.

FIG. 8D schematically illustrates a post 12*d* related to the embodiment of FIGS. 8A and 8B, which includes a bracket 42 for removably securing the shaft when the post is transported or stored. In an exemplary, but not limiting embodiment, bracket 42 includes a pair of opposed arms extending outwardly and away from the post, which grasp the shaft.

FIGS. 8E and 8F schematically illustrate a post 12e related to the embodiment of FIGS. 8A and 8B, which includes a support 38*b* that is rotatably coupled to the post via a pivot 44, such that when the support is in a first position (as shown in FIG. 8E), the shaft does not extend beyond a lower extent of the post, facilitating transportation and storage of the post. However, when the support is in a second position (as shown in FIG. 8F), the shaft does extend beyond a lower extent of the post, facilitating deployment of the post. Note that as shown in FIG. 8E, in a first support position a portion A of the shaft is disposed closer to an upper portion of the post, and the portable frame exhibits a compact form factor facilitating storage and transport, while in a second support position as shown in FIG. 8F, portion A of the shaft is disposed closer to a lower portion of the post, and the portable frame is ready for deployment to support the signage.

FIG. 8G schematically illustrates a shaft 36*a* for use in any of the exemplary embodiments of FIGS. 8A-8F, where rotary drive tool 40 includes a driving bit 50 specifically configured to engage a head 46 of the shaft. In an exemplary, but not limiting embodiment, head 46 includes a hexagonal depression 48, and bit 50 is sized and shaped to positively engage the depression. It should be recognized that the shape of head 46 and depression 48 are exemplary, rather than limiting, since many other different sizes and shapes can be employed for the depression and bit. Furthermore, as a further alternative, the depression can instead be incorporated into the bit, and the head of the shaft can then be sized and shaped to engage the depression in the bit.

While the frame including a post and arm hingedly coupled together represents a particularly preferred type of frame, it should be recognized that the rotatable shaft (employed to drive the shaft into the ground) disclosed above can be used together with a post and arm that are coupled together using other techniques. In other words, rather than using the novel shaft with the novel hinged frame disclosed herein, the novel shaft could also be used with conventional sign post/arm combinations (i.e., a post and arm combination that does not employ a collapsing hinge).

The signage (frames, and frames and bases) disclosed herein is particularly well suited for advertising in real estate and for small business. Such signage can also be employed for temporary safety signs used by businesses and governmental agencies, as well as signage used by individuals (to advertise events such as garage sales, or to provide information to guests at events such as weddings and birthday parties).

FIGS. 9A-9B schematically illustrates a signage system including a case 62 for storing a plurality of folding sign frames, wherein a plurality of clamshell type supporting bases can be attached to the case.

Referring to FIG. 9A, a signage system 60 uses case 62 to store and transport a plurality of folding sign frames 68 (generally as described above, where the folding sign frames include a post and an arm that are hingedly coupled together).

Case 62 includes a handle 64 and can optionally include wheels 70 to facilitate moving the case. As discussed above, in at least some exemplary embodiments, the supporting bases come apart, and separated base portions 66 can be secured to an outer surface of case 62 (using various attachment means, including but not limited to clips, hook and loop fasteners, cordage, etc.). In an exemplary but not limiting embodiment, case 62 can accommodate 10-20 folding frames. An optional handle 72 can be added to help roll the case from one location to another.

Case 62 can fit in the trunk of an average automobile, although it should be recognized that cases of other sizes are contemplated and included within the concepts disclosed herein. In this exemplary embodiment, case 62 includes a first half and a second half that are coupled together, much as in a conventional suitcase. Case 62 can include inserts sized and shaped to secure the folding frames. Preferably, folding frames are stored in both halves of case 62, as indicated in FIG. 9B.

Although the concepts disclosed herein have been described in connection with the preferred form of practicing them and modifications thereto, those of ordinary skill in the art will understand that many other modifications can be made thereto within the scope of the claims that follow. Accordingly, it is not intended that the scope of these concepts in any way be limited by the above description, but instead be determined entirely by reference to the claims that follow.

The invention in which an exclusive right is claimed is defined by the following:

1. A portable frame for signage, comprising:

(a) a post fabricated of a relatively light weight material;

(b) an arm attached to the post and configured to support signage depending from the arm;

(c) a hinge coupling the post to the arm, the hinge enabling the arm to fold against the post in a collapsed configuration when the portable sign is not in use, to facilitate storage and transport of the portable frame;

(d) a base comprising at least one outer face configured to accommodate additional signage, at least a portion of the base being configured to engage a substrate supporting the portable frame, the base comprising a central hollow member and a bottom opening aligned with the central hollow member, a distal portion of the post passing through the central hollow member and extending beyond the opening and into the substrate supporting the portable frame;

(e) a support attached to a lower portion of the post; and (f) a shaft configured to rotatably engage the support, the shaft having an upper head portion configured to be drivingly rotated by a rotary drive tool, and a lower portion configured to be driven into the substrate supporting the portable frame to support the post, such that drivingly rotating the shaft causes the lower portion of the shaft and a distal end of the post to be driven into the substrate, the shaft being parallel to the post, but not coaxial with the post.

2. The portable frame of claim 1, wherein the outer face comprises a mounting bracket for the additional signage.

3. The portable frame of claim 1, wherein the base comprises a shelf in an upper portion of the base, the shelf being configured to support decorative elements that extend outwardly from an upper portion of the base.

4. The portable frame of claim 1, wherein the base is configured to be broken down into a plurality of sections to facilitate storage and transport.

5. The portable frame of claim 1, wherein a size of the portable frame in the collapsed configuration is sufficiently compact so that the portable frame can be moved by a single person, and can fit within an automobile of average size.

6. The portable frame of claim 1, wherein a plurality of openings are formed in the post, to reduce the weight of the post, to reduce a wind resistance of the post, and to enable additional components to be attached to the post.

7. The portable frame of claim 1, wherein the support and shaft threadably engage each another, the support extending outwardly and orthogonally away from the post.

8. The portable frame of claim 1, wherein the lower portion of the shaft is formed as an auger to facilitate driving the lower portion into the substrate.

9. The portable frame of claim 1, wherein the support rotatably coupled to the post, such that in a first support position, the lower portion of the shaft is disposed closer to an upper portion of the post, and the portable frame exhibits a compact form factor facilitating storage and transport, and in a second support position, the lower portion of the shaft is disposed closer to a lower portion of the post, and the portable frame is ready for deployment to support the signage.

10. The portable frame of claim 1, wherein the shaft comprises a bracket for securing the shaft during storage and transport, such that when the shaft engages the bracket, the shaft does not extend beyond the post, wherein to erect the portable frame, the shaft is removed from the bracket and introduced into the support.

11. The portable frame of claim 1, further comprising a locking structure configured to lock the arm into an extended position in which it is generally orthogonal to the post, wherein the locking structure is either incorporated into the hinge or the locking structure comprises a lock pin that passes through aligned orifices formed in the post and the arm.

12. A portable frame for signage, comprising:

(a) a post that is fabricated to be relatively light weight;

(b) a support attached to a lower portion of the post;

(c) a shaft configured to rotatably engage the support, the shaft having an upper head portion configured to be drivingly rotated by a rotary drive tool, and a lower portion configured to be driven into a substrate to support the post, such that drivingly rotating the shaft causes the lower portion of the shaft and a distal end of the post to be driven into the substrate, the shaft being parallel to the post, but not coaxial with the post; and (d) an arm attached to the post and configured to support signage depending from the arm.

13. The portable frame of claim 12, further comprising a base configured to engage a lower portion of the post, the base having at least one outer face configured to accommodate additional signage, and an opening through which the distal end of the post can extend.

* * * * *